US005271321A

United States Patent [19]

Nordberg

[11] Patent Number: 5,271,321

[45] Date of Patent: Dec. 21, 1993

[54] TIRE COMPACTING MACHINE

[76] Inventor: Henry T. Nordberg, 510 Lake Rd., Oneida, N.Y. 13421

[21] Appl. No.: 933,363

[22] Filed: Aug. 21, 1992

[51] Int. Cl.[5] ..... B30B 15/00

[52] U.S. Cl. ..... 100/220; 100/214; 100/269 R

[58] Field of Search ..... 100/3, 12, 35, 214, 100/220, 269 R

[56] References Cited

U.S. PATENT DOCUMENTS

| | | | |
|---|---|---|---|
| 277,101 | 5/1883 | Babcock | 100/220 |
| 749,759 | 1/1904 | Tinsley | 100/220 |
| 2,659,907 | 11/1953 | Kramer | 100/220 X |
| 2,920,555 | 1/1960 | Sherriff . | |
| 3,000,295 | 9/1961 | Fenton | 100/269 R X |
| 3,129,658 | 4/1964 | Valente . | |
| 3,139,814 | 7/1964 | Sanders | 100/12 X |
| 3,195,444 | 7/1965 | McLean . | |
| 3,212,429 | 10/1965 | Fay et al. . | |
| 3,498,212 | 3/1970 | Boehm | 100/12 X |
| 3,675,569 | 7/1972 | Moor . | |
| 3,705,658 | 12/1972 | Harris . | |
| 3,802,337 | 4/1974 | St-Hiliare . | |
| 3,955,491 | 5/1976 | McMahon . | |
| 3,994,158 | 11/1976 | Weinhold | 100/269 R X |
| 4,006,678 | 2/1977 | Laurie et al. | 100/3 X |
| 4,141,396 | 2/1979 | McCallister . | |
| 4,155,300 | 5/1979 | Baltschun . | |
| 4,222,323 | 9/1980 | Martindale . | |
| 4,306,826 | 12/1981 | Detwiler . | |
| 4,615,366 | 10/1986 | Scarbrough, Jr. . | |
| 4,683,020 | 7/1987 | Portalupi et al. . | |
| 4,732,331 | 3/1988 | Hughes . | |
| 4,771,686 | 9/1988 | Triantos, Jr. . | |
| 4,793,124 | 12/1988 | Anderson . | |
| 4,805,507 | 2/1989 | Schmidt et al. . | |
| 5,056,428 | 10/1991 | Allen | 100/12 X |

FOREIGN PATENT DOCUMENTS

| | | | |
|---|---|---|---|
| 969600 | 10/1982 | U.S.S.R. | 100/12 |

*Primary Examiner*—Stephen F. Gerrity
*Attorney, Agent, or Firm*—Wall and Roehrig

[57] ABSTRACT

A small vertical tire compacting machine is provided in which a series of sets, each set containing a small quantity of tires to be compacted are sequentially and incrementally compacted between compacting heads, at least one of which is moveable hydraulically or otherwise. Upon addition and compaction of the final set of tires the fully compacted bundle is banded and removed for further handling and/or storage. The already compacted tires are retained on the machine, together with the about to be compacted tires, by a mandrel with retractable/expandable cams, or otherwise during the repeated operation of the machine.

7 Claims, 4 Drawing Sheets

TIRE COMPACTING MACHINE

BACKGROUND OF THE INVENTION

This invention relates to apparatus for compacting a number of low density annular objects into a single dense bundle for efficient storage and/or handling. More particularly, this invention relates to an apparatus for compacting a series of sets of vehicle tires into a dense compressed bundle for easy storage and/or handling.

In recent years, the disposal of unusable tires of all types has become an growing problem. With increased emphasis on the environment and recycling of materials, especially materials which are not biodegradable, it is no longer possible to merely burn or bury the millions of tires discarded each year in the United States. The tire, by the nature of its size and shape, occupies a large volume of space, particularly in proportion to its weight; thus, it presents a very awkward article to handle and store, especially in large numbers. Additionally, storage of large numbers of loose tires presents a significant fire hazard, while disposal of vast numbers of loose tires has a significant environmental impact.

In my U.S. Pat. No. 5,121,680 and 5,152,214, I have disclosed apparatus for compacting twenty automobile tires into a compressed bundle occupying the volume of three or four uncompacted tires stacked atop each other. Typically, machines of this type extend fifteen to twenty feet from end to end to accommodate the large number of tires that must be processed simultaneously through the machine. Many smaller tire centers, individual garages, and the like that mount new tires and have to accept for disposal old tires, cannot spare the floor space or afford the cost of large production machines such as disclosed in my co-pending prior applications. In addition, the personnel of such facilities may not wish to cumulate a large number of tires before being able to compact them. Nonetheless these smaller facilities must handle a significant number of tires which require either a large storage area or frequent pick-ups by a disposal agency and thus constitutes substantial problems for the facility operator.

OBJECTS AND SUMMARY OF THE INVENTION

Accordingly, it is an object of the present invention to provide a machine for compacting vehicle tires that is itself relatively compact and can be economically manufactured for use in a small volume operation.

It is another object of the present invention to provide a tire compacting machine which requires very little floor space for installation.

It is yet another object of the present invention to provide a tire compacting machine in which small sets of tires can be serially processed to yield a single dense bundle for further handling and disposal.

It is another object of the present invention to provide a tire compacting machine which can successively position and retain a set containing a relatively small number of tires at a time about a mandrel, compact the set, and cumulate the compacted sets until the machine capacity is reached, at which time the compacted tires are banded into a dense single bundle for removal and further processing.

These and other objects of the present invention are attained in a compacting machine having a frame, a fixed compactor head and a central mandrel at one end of the machine, with the mandrel being adapted to receive thereabout tires to be compacted. A movable compactor head is positioned at the opposite end of the machine. A set containing a small number of tires is placed on one compactor head, placed so that it will be centered about the mandrel, and compressed. The compressed tires are secured in position on the mandrel until successive sets have been added to those already placed about the mandrel and compacted until a fully compacted bundle of tires of a size corresponding to the capacity of the machine is achieved. The tires in the fully compacted bundle are banded together and removed from the machine for further handling.

BRIEF DESCRIPTION OF THE DRAWINGS

For a better understanding of these and other objects of the present invention, reference is made to the detailed description of the invention which is to be read in conjunction with the following drawings, wherein.

DETAILED DESCRIPTION OF A PREFERRED EMBODIMENT

Figure 1:
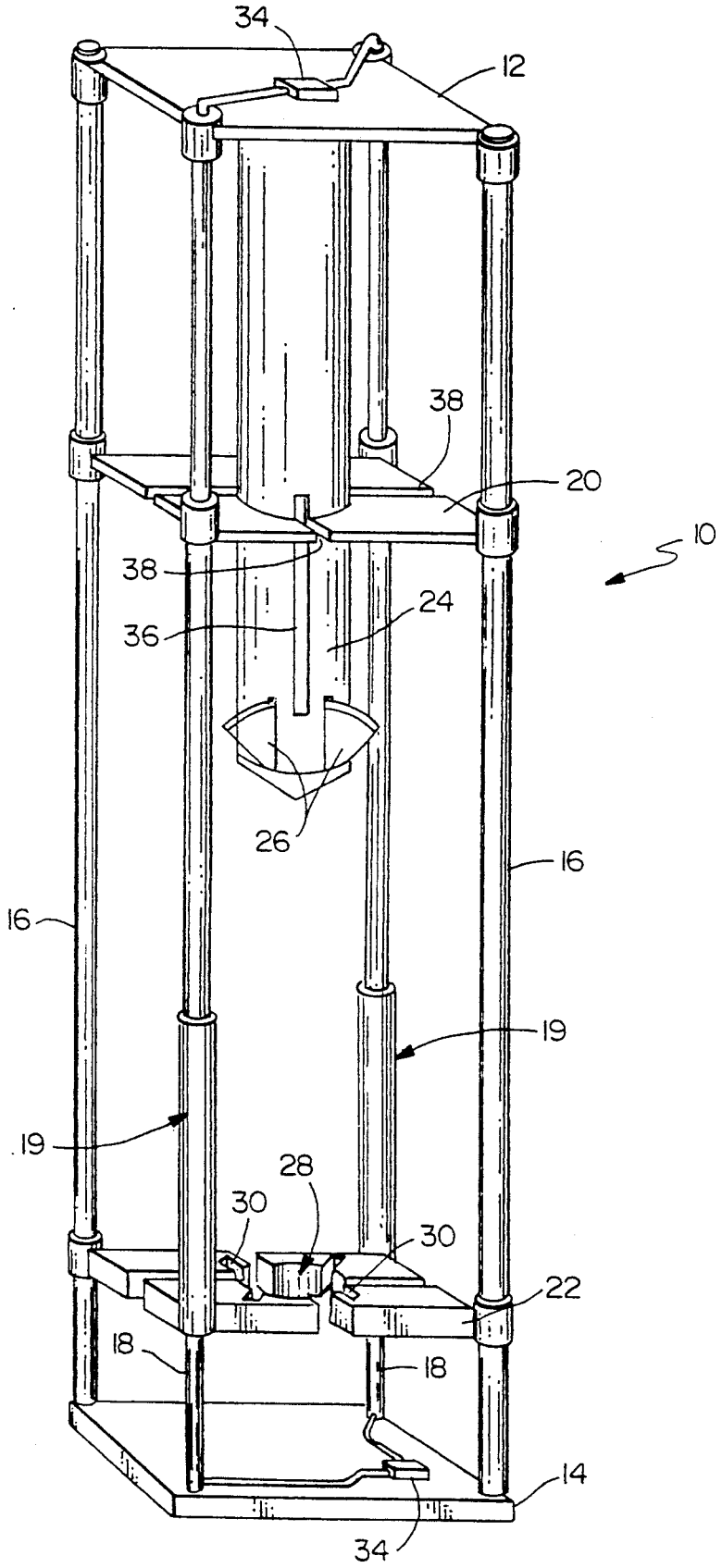
FIG. 1 is a perspective view of a machine according to the present invention.

Referring now to FIG. 1, the tire compacting machine 10 according to the present invention comprises a first frame end member 12 and a second frame end member 14 joined together by two pairs of tie bars 16—16 and 18—18 to form an elongated vertical structure therebetween. As will be described in more detail below, the pair of vertical tie bars 18—18 also form part of hydraulic drive units 19—19 for moving a movable compactor head 22 into and out of a compacting relationship with a fixed compactor head 20, as will be described hereinafter.

Figure 7:
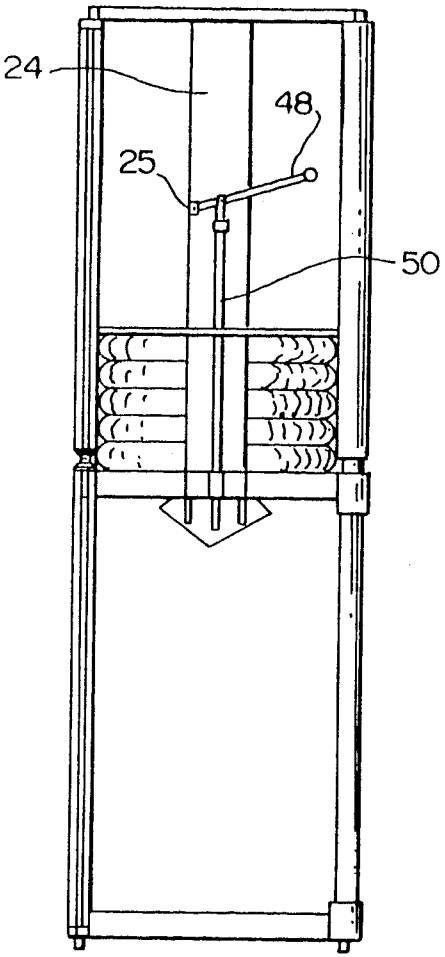
FIG. 7 is a side elevation partially broken away showing the actuating lever and mechanism for retracting and extending the tire supporting cam members to support a set of compacted tires, the quantity of tires in the set being less than the overall capacity of the machine.

Mounted, parallel to and at a pre-set distance from the first frame end member 12, is a fixed compactor head 20 through which the pairs of tie bars 16—16 and 18—18 pass. Projecting from the fixed compactor head 20 toward the moveable compactor head is a central mandrel 24. The mandrel has four extendable/retractable cam members 26—26 mounted about the circumference at ninety degree intervals at the free end of the mandrel 24. Slidably mounted about the pairs of tie bars 16—16 and 18—18 is the moveable compactor head 22. The moveable compactor head 22 is adapted to be slidably moved from an extended position to a fully compressive position. In the extended position, the moveable compactor head 22 is adjacent to the second frame end member 14, with sufficient clearance to accommodate one of the hydraulic manifolds 34. When in a fully compressive position the moveable compactor head is adjacent to the fixed compactor head 20 (FIG. 7).

The moveable compactor head 22 has therein a central aperture 28 which is configured to match the size and shape of the mandrel 24 and to allow the mandrel 24 to extend therethrough when the moveable compactor head 22 is in its compressive position. Also formed in the movable compactor head 22 are four grooves 30 which are adapted to fit about the extended cam members 26 and allow them to slide therethrough when the movable compactor head 22 approaches the fully compressive position.

The first frame end member 12 is the same shape and size as the second frame end member 14, with the distance between opposing side edges for each member being approximately equal to the diameter of the largest tire size which the machine is designed to compact. Each of the four tie bars 16—16 and 18—18 is affixed to one corner of the frame end members by welding or other like means. A hydraulic manifold 34 is provided on the surface of each frame end member to distribute hydraulic fluid from a power source (not shown) to respective drive units 19—19 on the tie bars 18—18.

The pairs of tie bars 16—16 and 18—18 also extend through and are affixed by welding or other like means to a fixed compactor head 20 which is spaced at a pre-set distance from the first frame member 12; this pre-set distance is sufficient for the incorporation therebetween of a mechanism for retracting and extending the cam members 26, which will be described in greater detail below. Banding slots 36 (FIG. 1) are formed at ninety degree intervals around the mandrel 24 and cooperating slots 38 are provided in the fixed compactor head 20 so that when a full complement of tires is compacted about the mandrel, banding material can be inserted through the slots 36 and 38 and around the tires to securely fasten the compacted tires together, forming a relatively small bundle. Mandrel 24 extends from fixed head 20 toward moveable head 22 for a distance of approximately twenty-four inches; the mandrel also extends between the first frame end member and the fixed compactor head to provide a combined spacer and stiffening member for the frame. Mandrel 24 is sized to accommodate the tires to be compacted and generally has a somewhat smaller diameter than the inside diameter of the smallest tires to be compacted by the machine. The mandrel serves to guide the tires into an orderly bundle as well as to prevent undue lateral displacement of the tires during compaction.

Figure 4:
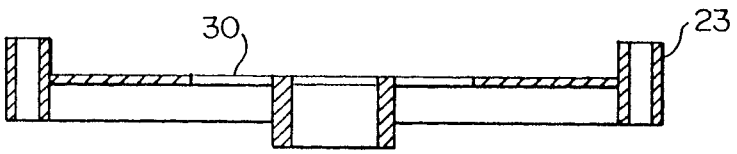
FIG. 4 is a section on line 5—5 of FIG. 3.
Figure 2:
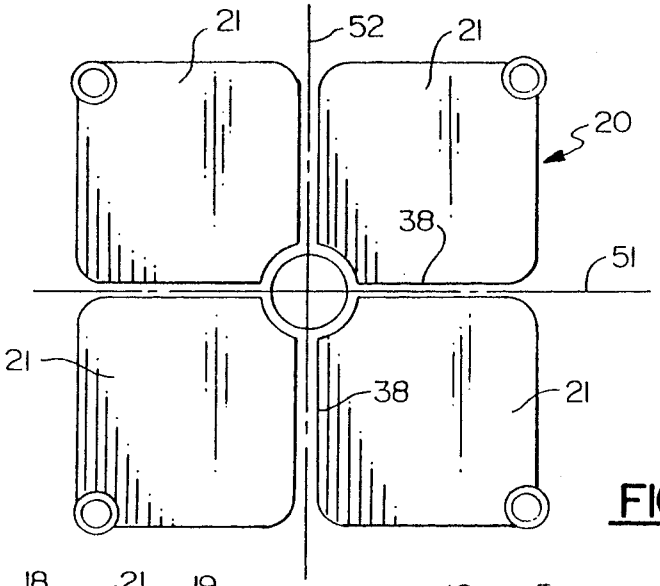
FIG. 2 is a plan view of the fixed compactor head.
Figure 3:
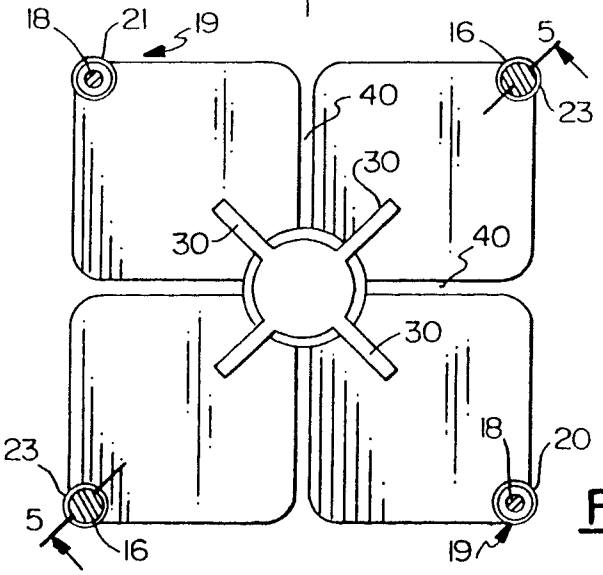
FIG. 3 is a plan view of the movable compactor head.

As may be seen in FIG. 2, the fixed compactor head 20 is composed of four identical segments 21—21 distributed about a twofold axes 51 and 52 for the purposes indicated above. The moveable compactor head 22 is shown in plane view in FIG. 3 and has a somewhat similar configuration to the fixed compactor head 20, since it also requires banding slots 40 for allowing banding of the compacted bundle of tires. The moveable compactor head 22 also contains therein slots 30—30 which are sized to fit over the extended mandrel cams 26—26 when the moveable compactor head 22 is in its most compressive position. The moveable compactor head 22, as can be seen in FIGS. 3 and 4, has at two diagonally opposed corners cylindrical bushing members 23—23 for guiding the moveable compactor head along the tie bars 16—16 under the control of the hydraulic drive units 19—19 formed as an integral part of the tie bars 18—18. The moveable compactor head 22 is secured to the outer cylinders 21—21 of the hydraulic drive units. These outer cylinders 21—21 are slidably moveable inside sleeves 31—31 which hold the fixed compactor head 20 to tie bars 18—18.

As will be explained in greater detail below, the cylinders and the compactor head secured therebetween are moved by hydraulic pressure along the tie bars 18—18 toward and away from the fixed compactor head to compress a set of tires therebetween. The compacting cycle is repeated sequentially for a series of sets to produce a maximum of twenty-one compressed tires which are ultimately banded together to form a bundle of compressed tires. These compressed tires have a height about equal to three or four uncompressed tires.

Figure 5:
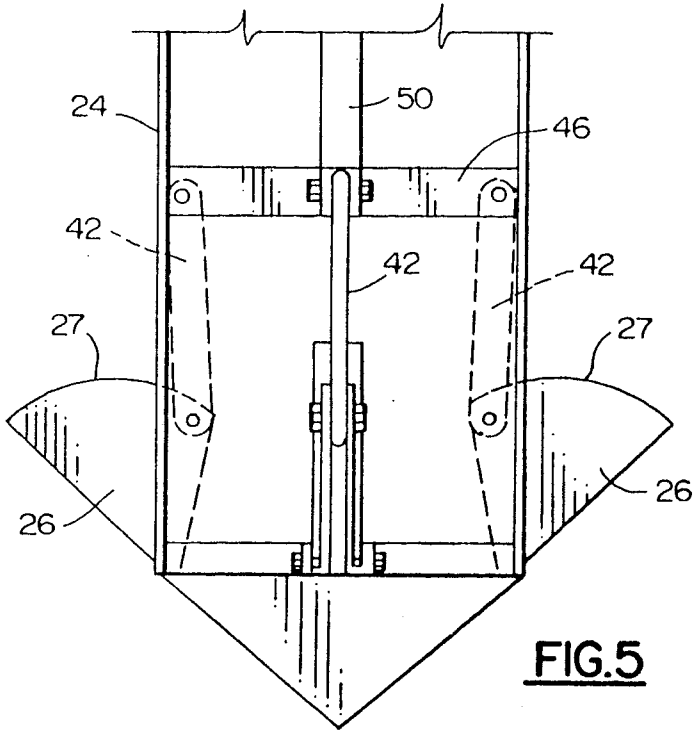
FIG. 5 is a partial view of the central mandrel illustrated in FIG. 1 showing the tire supporting cam members in the extended position.
Figure 6:
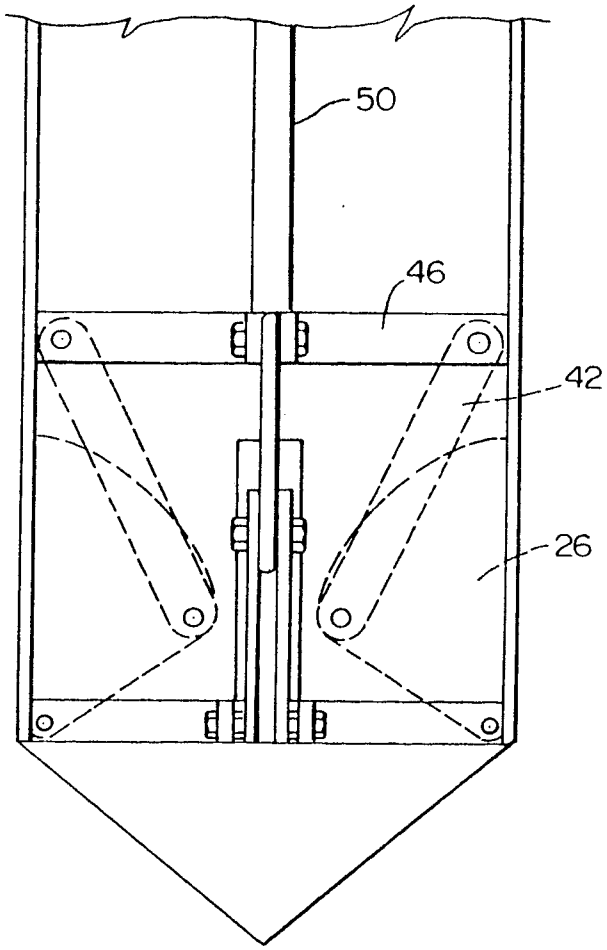
FIG. 6 is a view similar to FIG. 5 showing the tire supporting cam members in the retracted position.

Referring now to FIGS. 5 and 6, there is shown the details of the retractable extendable cams 26 which are used to support successive compressed sets of tires about the mandrel 24 while the moveable compactor head 22 is being moved to allow placement of the next set of uncompressed tires in the machine. Successive sets of tires are thus placed in the machine and compressed until the capacity of the machine is reached. Cam members 26—26 are connected by lever 42 to an enclosed plate 46. The enclosed plate in turn is connected by short tie rod 50 to a manually operated lever 48 pivotally fixed to the inner wall of the mandrel 24 at point 25 above the fixed compactor head 20. Actuation of lever 48 moves the enclosed plate 46 which, through links 42, retracts or extends the cam members 26—26. The cam members 26—26 are sized so that in the extended position, any tires positioned about the mandrel 24 outside the curved surface 27 of the cam members 26—26 will rest upon the curved surfaces 27 and be held in position about the mandrel 24 while the compactor head 22 is moved to receive another quantity of tires.

The manually operated lever 48 can be replaced with an automatically actuated lever mechanism that is triggered by a sensing device when the moveable compactor head 22 reaches a predetermined position.

Referring now to FIGS. 1 and 7, in operation, the device is generally used to sequentially place sets containing small quantities of tires about the mandrel 24 and increasingly compacting them until the final tire set is added. At this point the densely compacted single bundle is banded, and removed from the machine. Thus, in the preferred embodiment, wherein the movable compactor head is below the fixed compactor head 20, a set of five to seven tires is stacked on top of the movable compactor head 22 with the head fully extended. The apparatus is then energized to introduce fluid into the cylinders 19 so as to move the movable compactor head 22 until it passes the cam members 26—26. The first set of tires is lightly compressed since the tires contain substantial amounts of air at this point. Compression, thus occurs only until the cam members 26—26 can be extended outwardly as shown in FIG. 1 to receive and hold the tires against the fixed compactor head 20. The movable compactor head 22 is then moved adjacent to the second frame end member and the next set of tires placed on the moveable head. This next set of tires is partially compacted together with the first set of tires previously retained on the mandrel 24.

In some cases, the sets of tires will in passing the cam members 26—26, push against the cam members 26—26, causing them to retract automatically. If necessary, however, the cam members 26—26, are manually retracted out of the way by lever 48 until the movable compactor head 22 has moved the tires sufficiently past the cam members 26—26 so that the tires clear the upper surface of the cams allowing the cam members 26—26 to be extended again.

Figure 8:
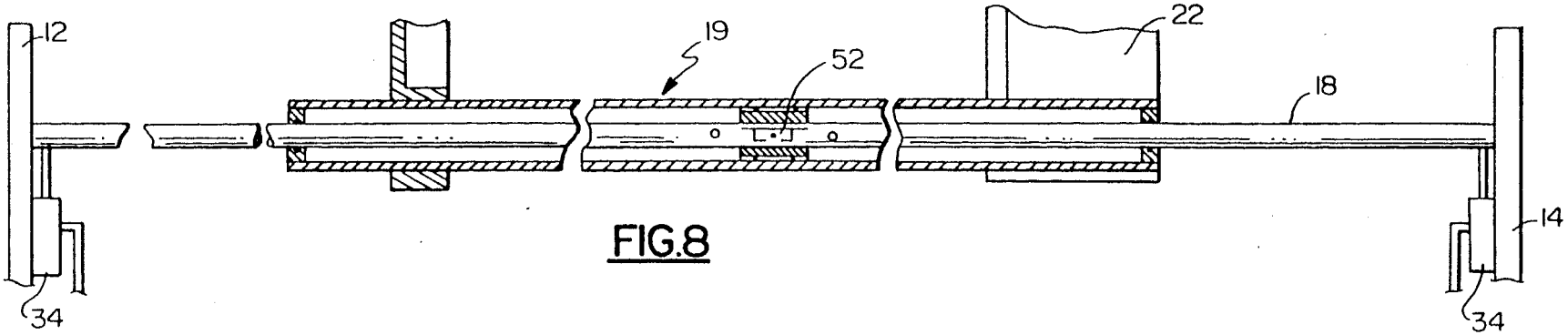
FIG. 8 is a partial view in section showing a hydraulic drive cylinder unit mounted upon one of the tie bars making up the machine frame.
Figure 9:
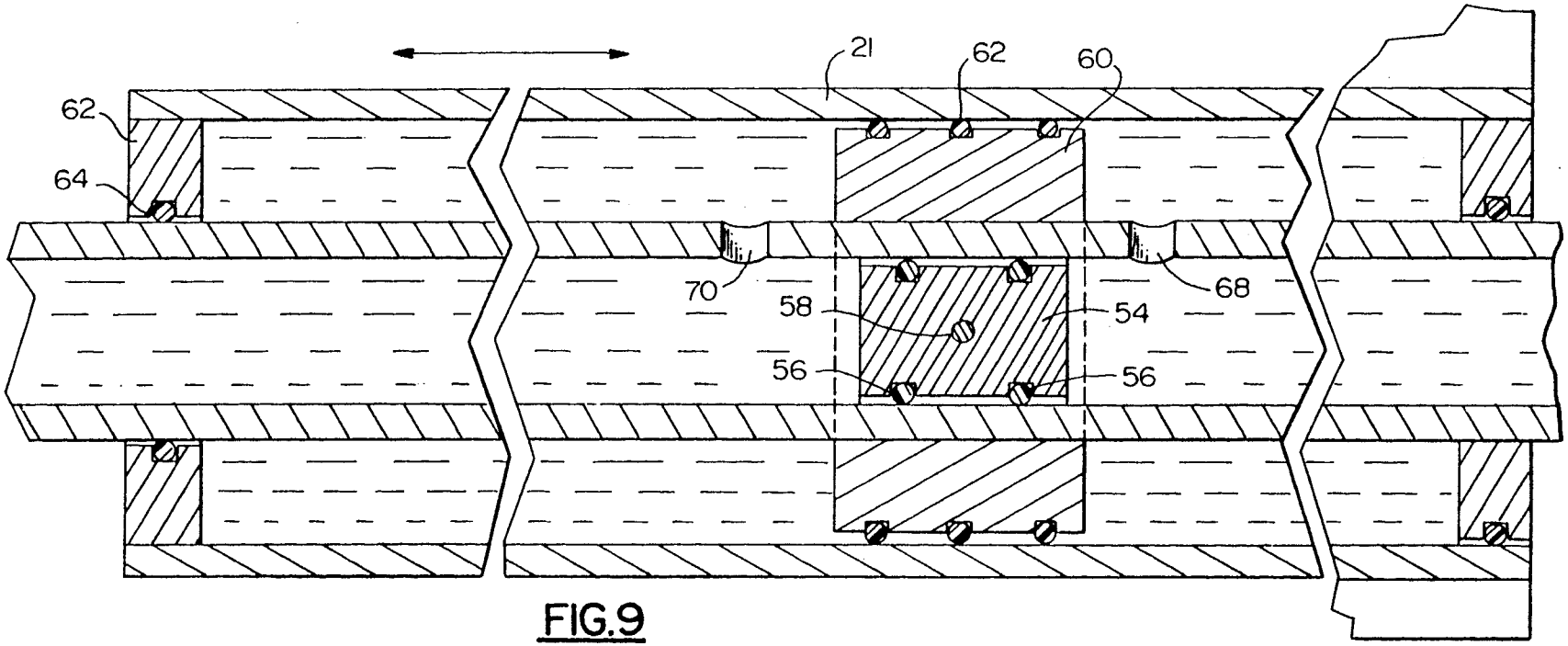
FIG. 9 is an enlarged view in section showing the drive cylinder unit utilized in the present invention in greater detail.

Referring now to FIGS. 8 and 9 there is shown in longitudinal cross-section the hydraulic drive units 19—19 formed about the tie bars 18—18. The hydraulic cylinders of these units reciprocate the moveable compactor head 22 between the extended compressed positions. The tie bars 18—18 are hollow tubes and the interiors of each tie bar 18—18 are connected at each end to the hydraulic system 34 as shown in FIG. 1. At the center of each tie bar 18 is a fixed piston 52 which, as may be seen in FIG. 9, is an annular metal ring with gland seals 56 formed at each side to seal the interior of the tube against passage of hydraulic fluid in either direction. The fixed piston 52 is pinned in the tube 18 by a pin 58 at the center of the fixed piston. The fixed piston allows the interior of each tie bar 18 to function as a hydraulic fluid duct. The hollow cylinder 21 is mounted about the tie bars 18—18 and becomes the movable element of each hydraulic drive unit 19. Also fixed about the center of the tube 18 is an annular ring 60 which has sealing glands 62 which allow movement of the hollow cylinder 21 relative to ring 60, but prevents passage of hydraulic fluid past the ring 60. As can be seen in FIG. 9, the ends of the hollow cylinder 21 are closed by end caps 64 and seals 66 to form with the hollow cylinder 21 a dual chamber hydraulic cylinder which then becomes the drive unit for reciprocating moveable compactor head 22 through each compacting cycle. Hydraulic fluid is introduced, through the port 68 in tie bar 18 (shown in FIG. 9 on the right hand side of the fixed piston) and causes the hollow cylinder 21 to move (to the right in FIG. 9) until it reaches its fully compressive position. At this time fluid in the opposite side of the cylinder is returned to the fluid reservoir via port 70. Conversely, if hydraulic fluid is introduced through the port 70 (on the left hand side of ring 54 in FIG. 9), hollow cylinder 21 will be moved in opposite direction (left in FIG. 9) until it reaches the full extent of its stroke, thereby bringing the moveable compactor head to its fully compacted position. Fluid may then be vented through port 68. As noted above, the tie bars 18—18 are connected to a hydraulic fluid source (not shown) via manifolds 34 which, with suitable valves and sensors as is well known in the art, control the application of hydraulic fluid to the hydraulic cylinders of the drive unit 19 on which the moveable compactor head 22 is mounted. This construction and the hollow tube shaped tie bars 18—18 eliminate the need for moving hydraulic hoses and provides an efficient apparatus for moving the moveable compactor head 22 to compact tires placed in the machine.

Each compacting cycle is repeated, as often as needed to fill the capacity of the machine. The machine, in the present embodiment, is sized to hold a maximum of twenty-one tires when fully compacted. If a set of seven tires (the maximum number of uncompressed tires the machine will accept in a cycle) is placed on moveable compactor head 22 for each cycle, three compaction cycles are required to form a finished, highly compacted and dense bundle positioned about the mandrel 24. At this point, the compacted bundle is banded by inserting a banding material through the slots 36 and 38 and fastening the bands about the bundle at ninety degree intervals to securely hold the twenty-one tires in the compacted condition. After the bands are securely in place, the cams 26 are retracted and the compacted bundle removed from the machine. In the position indicated in FIG. 1 the compacted bundle may drop from the mandrel 24 and rest on the moveable compactor head 22 after the cams 26 are retracted. Auxiliary injection apparatus, not shown, can be used to kick the bundle from the machine, or it may be picked up in any suitable fashion as is well known in the industry. If the machine is inverted, the same process will occur except that tires will be stacked with the bottommost tire(s) resting on the fixed compactor head 20 and around the mandrel 24 prior to compaction, and the compacted bundle is lifted off rather than dropped from the mandrel 24.

Although reciprocation of the moveable compacting head has been described using hydraulic pressure, reciprocation may also be effected by other well known means such as compressed air pressure, or manual or electrically actuated means. It is also possible to use two moveable compactor heads which reciprocate toward and away from one another.

By providing a frame member which can be oriented vertically for compacting the tires and by compressing a small number of tires at a time, the present apparatus is able to substantially decrease the amount of space and the volume and height required for a compacting machine. The machine shown in FIG. 1, for instance, is approximately three feet square on a side and has a height of approximately ten feet. The mandrel 24 as indicated above, is approximately twenty-four inches, and the distance from the free end of the mandrel to the moveable compactor head in the fully retracted position is approximately four or five feet, resulting in a very compact, yet highly efficient machine for compacting relatively small quantities of tires. A machine of this type, being small and compact, can be constructed much more economically than tire compressing machines currently being used.

Most states now impose restrictions on the number of loose tires that can be stored at a location. With the ability to compact small quantities of tires, fewer loose tires need to be stored. Bundled tires also present a lesser risk of fire than non-compacted tires, because in the very dense compacted condition, tires do not readily support combustion. Thus, not only will small garages be able to save space, they will fully comply with environmental and safety requirements of most states for the handling of used tires.

While this invention has been explained with reference to the structure disclosed herein, it is not confined to the details set forth and this application is intended to cover any modifications and changes as may come within the scope of the following claims:

What is claimed is:

1. An apparatus for compacting a quantity of tires having side walls into a tightly compressed bundle the apparatus comprising:

a frame;

a first stationary compacting head mounted in said frame;

a second reciprocating compacting head mounted in said frame, said second head being capable of coacting with said first head;

cyclicable drive means for moving said second head between a fully extended position wherein a set of tires of at most a given quantity can be stacked between the first head and the second head, and a fully compressive position wherein the set of tires is compressed between the first head and the second head;

holding means for securing compressed tire sets against said first head between drive cycles so that a plurality of tire sets can be compressed into a single tightly compacted bundle, wherein said holding means comprises:

a central mandrel, having an end and said end having a circumference, said central mandrel being mounted on said first compacting head and extending toward said second compacting head;

a mating aperture formed in said second compacting head sized to receive therein said central mandrel; and compressible retaining means for accepting tires about said central mandrel and retaining said tires about said central mandrel;

wherein the tires are easily removable from said retaining means.

2. The apparatus of claim 1 wherein said compressible retaining means for accepting tires about said central mandrel and retaining said tires about said central mandrel comprises:

a plurality of retractable cam members positioned about the circumference of the end of said mandrel and extending toward said second compactor head;

means for selectively extending and retracting said cam members, said cam members being extended to retain the tiers upon the mandrel, and said cam members being retracted to allow placement of uncompressed tires on and removal of bundles of compressed tires from about said mandrel.

3. The apparatus of claim 2 wherein said central mandrel has a length between said first compacting head and said cam embers sufficient to hold twenty-one compacted tires and a length between said second compacting head and the end of said mandrel with said cam members extended sufficient to receive seven uncompacted tires.

4. The apparatus of claim 2 wherein said cam members are pivotally mounted on said mandrel adjacent the end of said mandrel and said means for selectively retracting and extending said cam members comprises:

a movable enclosed plate;

an actuating lever connected to said enclosed plate; and a plurality of swinging levers pivotally attached at a first end to said enclosed plate and at a second end to said cam members so that upon operation of said actuating lever, said cam members are retracted and extended relative to said mandrel.

5. The apparatus of claim 2 wherein said plurality of cam members comprises four cams spaced apart at ninety degree intervals about the circumference of said mandrel; and said cam members in the extended position have a radial dimension sufficient to engage the side walls of the tires to be compacted thereby holding said tires about said mandrel.

6. The apparatus of claim 1 wherein:

said frame is elongated and comprises four longitudinal tie bars of which at least a first pair of tie bars is diagonally opposite one another, said four tie bars joining a first frame end spaced apart from a second frame end;

a hydraulic cylinder member is attached to said second compacting head and extends between said second compacting head and said first compacting head; and at least one hydraulic cylinder member comprises a pair of hollow tube hydraulic cylinders formed in said first pair of tie bars and two remaining of the four tie bars serve as guide members only for said second compacting head.

7. The apparatus of claim 6 wherein said elongated frame is positioned vertically with said first compacting head positioned toward the top of said frame so that successive quantities of tires to be compacted are raised up about said central mandrel by said second compacting head until such time as a desired quantity of tires is compacted into a dense bundle, whereupon the bundle is banded together through banding slots and the banded bundle lowered from the central mandrel for removal from the apparatus.

* * * * *